US005269265A

United States Patent [19]

Pretzsch et al.

[11] Patent Number: 5,269,265

[45] Date of Patent: Dec. 14, 1993

[54] COOLING-AIR BLOWER HAVING A COMBUSTION-AIR CHANNEL WHICH TAPS A COMPONENT AIR FLOW FROM A COOLING-AIR CHANNEL

[75] Inventors: Peter Pretzsch, Schorndorf; Michael Kein, Korb; Peter Linsbauer, Remshalden, all of Fed. Rep. of Germany

[73] Assignee: Andreas Stihl, Waiblingen, Fed. Rep. of Germany

[21] Appl. No.: 14,815

[22] Filed: Feb. 8, 1993

[30] Foreign Application Priority Data

Feb. 6, 1992 [DE] Fed. Rep. of Germany ..... 4203355

[51] Int. Cl.[5] ..... F01P 1/00

[52] U.S. Cl. ..... 123/41.56; 123/41.65; 123/41.7; 123/198 E

[58] Field of Search ..... 123/41.56, 41.63, 41.65, 123/41.7, 198 E

[56] References Cited

U.S. PATENT DOCUMENTS 4,261,302 4/1981 Sheldon ..... 123/41.56

4,537,160 8/1985 Shirai ..... 123/41.65

FOREIGN PATENT DOCUMENTS 3708289 9/1987 Fed. Rep. of Germany .

442232 12/1985 Sweden .

*Primary Examiner*—Noah P. Kamen

*Attorney, Agent, or Firm*—Walter Ottesen

[57] ABSTRACT

The invention is directed to a cooling-air blower for an internal combustion engine including a two-stroke engine of a portable handheld work apparatus. Cooling air is guided by a cooling-air channel to an internal combustion engine and a combustion-air channel conducts air to the intake pipe of the engine. A portion of the cooling-air flow is tapped at the pressure end of the blower. A segment of the combustion-air channel is disposed next to the cooling-air channel. A profile hollow body having a streamlined configuration extends from this segment of the combustion-air channel into the cooling-air channel. The profile hollow body is aligned at its location in the cooling-air channel with the flow direction of the cooling-air flow and has a rear end facing away from this flow. An inlet opening is provided in this rear end of the hollow body for receiving a portion of the cooling-air flow which is then passed to the combustion-air channel through the hollow body. The streamline configuration and location of the inlet opening permit a large quantity of air to be tapped without disturbing the cooling-air flow and without taking along dirt particles entrained in the cooling-air flow.

21 Claims, 4 Drawing Sheets

Fig. 5
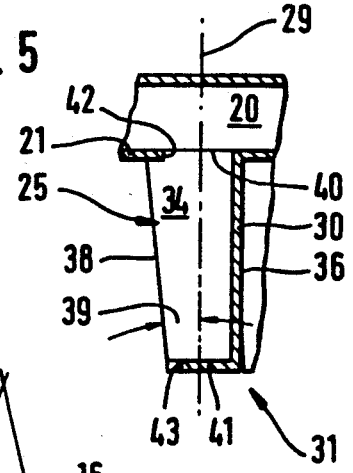
Fig. 6
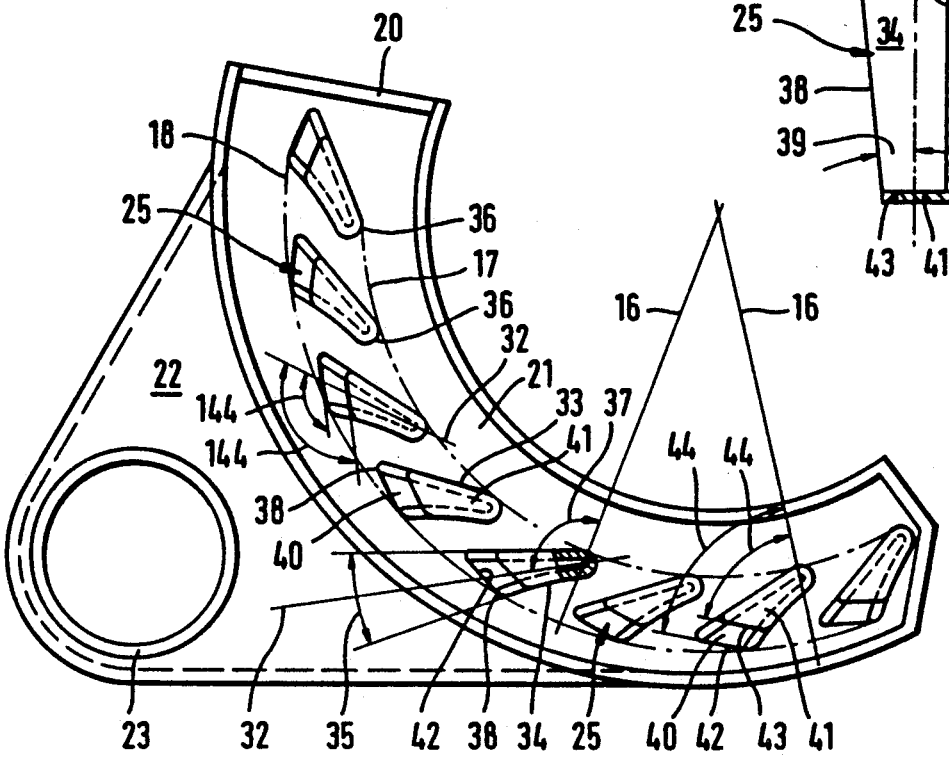
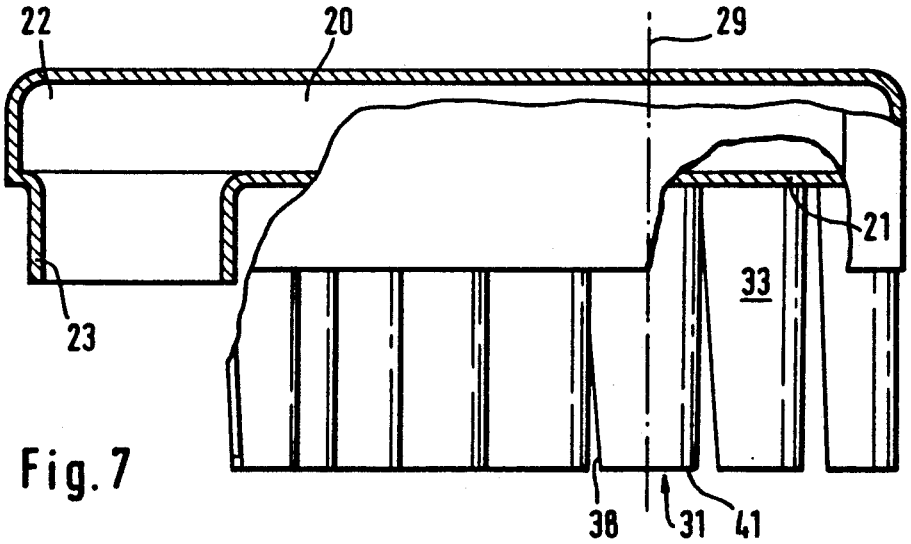
Fig. 7

COOLING-AIR BLOWER HAVING A COMBUSTION-AIR CHANNEL WHICH TAPS A COMPONENT AIR FLOW FROM A COOLING-AIR CHANNEL

BACKGROUND OF THE INVENTION

Published Swedish patent application 442,232 discloses a cooling-air blower wherein the combustion-air channel lies approximately in a plane parallel to a radial fan wheel and axially delimits a cooling-air spiral surrounding the fan wheel. An annular slit is provided in the combustion-air channel and faces toward the cooling-air channel. The annular slit is covered with respect to the fan wheel by a baffle plate in order to prevent a direct entry of dirt particles entrained by the cooling air into the combustion-air channel. A significant disturbance of the cooling-air flow in the cooling-air spiral occurs because of the long annular slit whereby the cooling of the internal combustion engine can be affected. Furthermore, the annular slit is disposed near the outlet of the cooling-air spiral where there is a relatively high static pressure which facilitates the passage of dirt particles from the cooling-air flow into the combustion-air channel.

SUMMARY OF THE INVENTION

It is an object of the invention to provide a cooling-air blower of the kind described above which is improved so that a large quantity of air for combustion can be branched off with only a slight disturbance of the cooling-air flow. In this way, the cooling air passing over will be substantially free of dirt particles.

The invention is directed to a cooling-air blower for an internal combustion engine including a two-stroke engine of a portable handheld work apparatus, the engine having an intake pipe for receiving combustion air required for the operation of the engine. The cooling-air blower includes: a housing; a fan wheel disposed in the housing and operatively connected to the engine for generating a cooling-air flow; the housing having a cooling-air channel formed therein for conducting the cooling-air flow to the engine; the housing also having a combustion-air channel for conducting the combustion air to the intake pipe of the engine; the combustion-air channel having a segment thereof adjacent the cooling-air channel; the housing including a profile hollow body extending from the combustion-air channel into the cooling-air channel; the profile hollow body having an interior communicating with the combustion-air channel and being aligned in the cooling-air channel in the flow direction of the cooling-air flow; the profile hollow body having a rear end facing away from the flow direction; and, the rear end defining an inlet opening therein for tapping and passing cooling air from the cooling-air channel through the interior and into the combustion-air channel.

The profile hollow body has a streamline configuration and therefore a low aerodynamic resistance. This configuration of the profile hollow body and its orientation in the cooling-air channel directed toward the flow direction of the cooling-air flow at its location in the cooling-air channel guarantee a disturbance which is only minimal notwithstanding the arrangement in the cooling-air flow. This disturbance has no significant influence on the performance of the cooling blower for cooling the engine. An optimal configuration of the cooling-air channel already made in the housing of a work apparatus must therefore not be changed.

The inlet opening for the air crossover from the cooling-air channel into the combustion-air channel is then on the rearward end of the profile hollow body facing away from the flow. A direct entry of the dirt particles into the combustion-air channel is prevented because of the arrangement of the inlet opening on the end of the profile hollow body facing away from the flow and because of the mass inertia of the dirt particles which fly past in the two-phase flow (air and dust). This effect is supported by the pressure relationships associated with the separation of the air flow at the rear edge. The configuration of the intake cross section for the combustion air offers the assurance of an intake speed which is low at the profile referred to the main cooling-air flow. The energy of the this intake speed is not sufficient to draw in significant portions of the particle spectrum by suction. The configuration provided by the invention therefore leads to an effective separation of dirt.

In addition, the arrangement ensures that the carburetor can be operated in the same manner as though the combustion air was drawn in by suction directly from the ambient. Notwithstanding the tap or takeoff in the cooling channel, comparable pressure relationships result so that an adjustment or resetting of suitable carburetors is unnecessary especially during retrofits.

According to another advantageous feature of the invention, a plurality of profile hollow bodies are arranged preferably at equal spacings one behind the other in the longitudinal direction of the cooling-air channel. Each individual profile hollow body can be made relatively small because of the arrangement of several profile hollow bodies whereby the disturbance of the cooling-air flow in the cooling-air spiral is further minimized. The pass-through area required for the air volume crossing over is ensured by the sum of the individual inlet openings on the rearward ends of the respective profile hollow bodies.

BRIEF DESCRIPTION OF THE DRAWINGS

The invention will now be described with reference to the drawings wherein:

FIG. 5 is a section view through a profile hollow body of the combustion-air channel taken along line A—A of FIG. 4;

FIG. 6 is a plan view of the combustion-air channel as seen from the inner wall of the cooling-air channel; and, FIG. 7 is a detail plan view of the combustion-air channel.

DESCRIPTION OF THE PREFERRED EMBODIMENTS OF THE INVENTION

Figure 1:
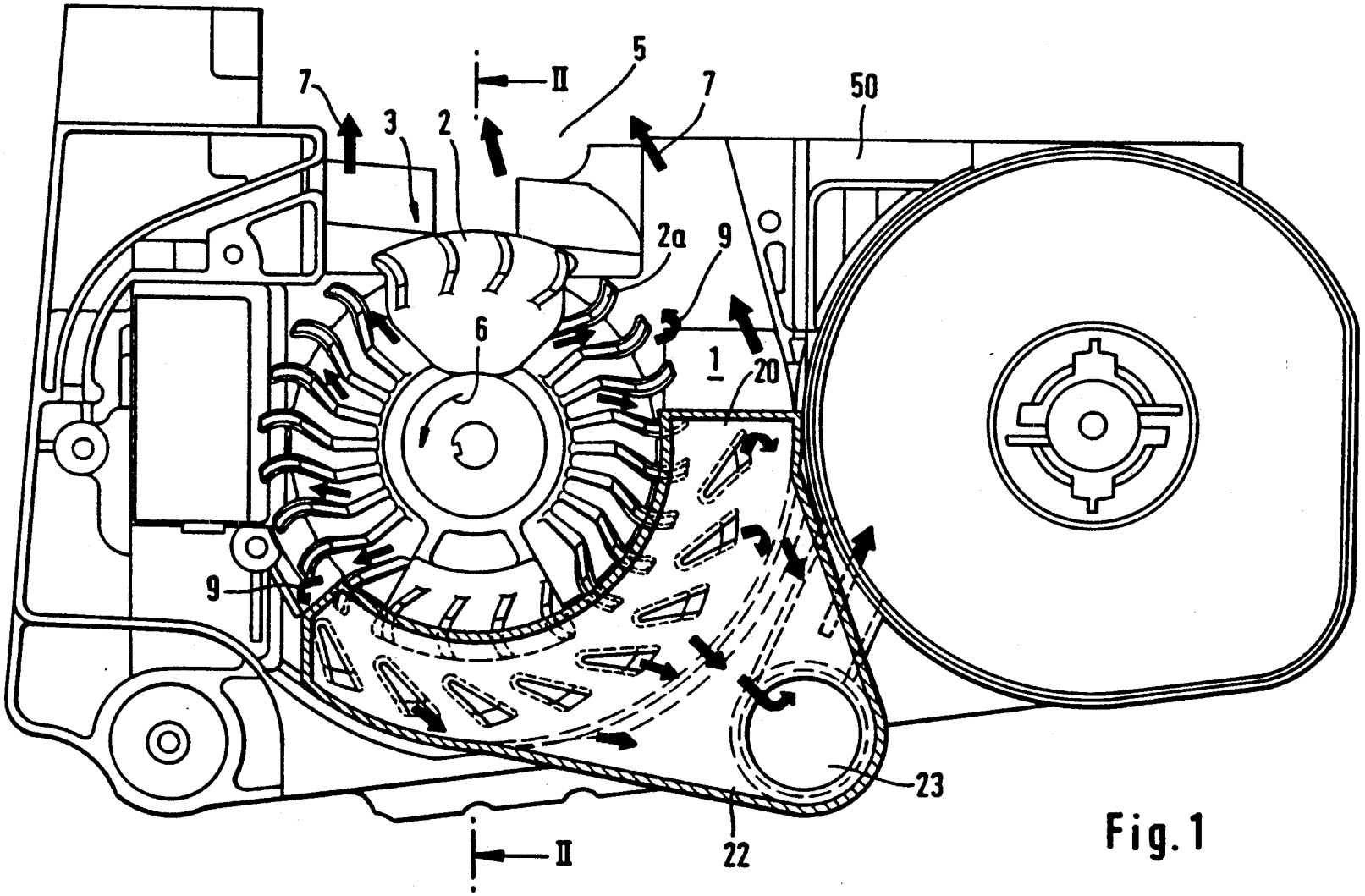
FIG. 1 is a section view of a cooling blower arranged in the housing of a work apparatus with the cooling blower having a combustion-air channel which taps air from a cooling-air channel.
Figure 2:
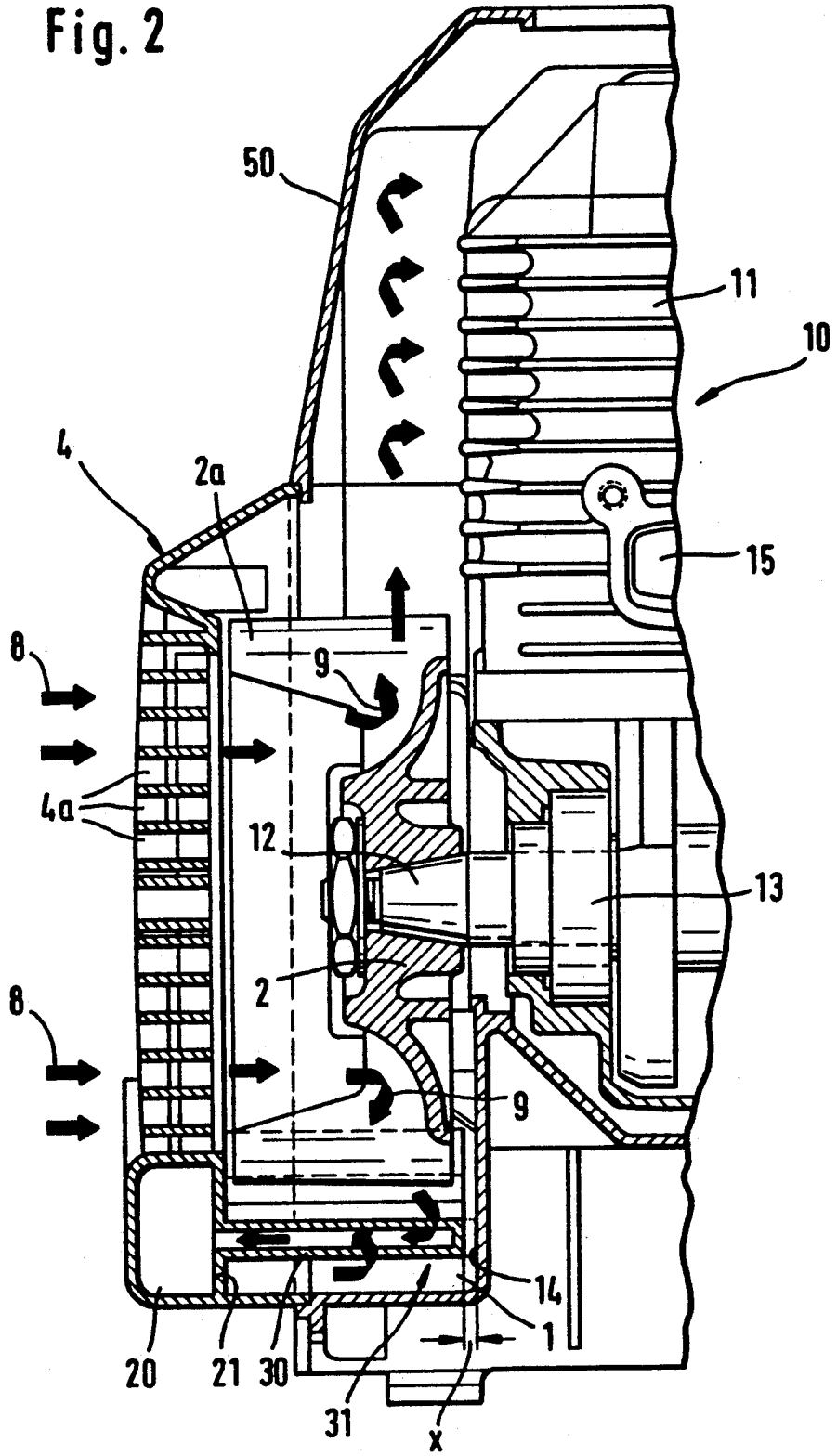
FIG. 2 is a section view taken along line II—II of FIG. 1.
Figure 3:
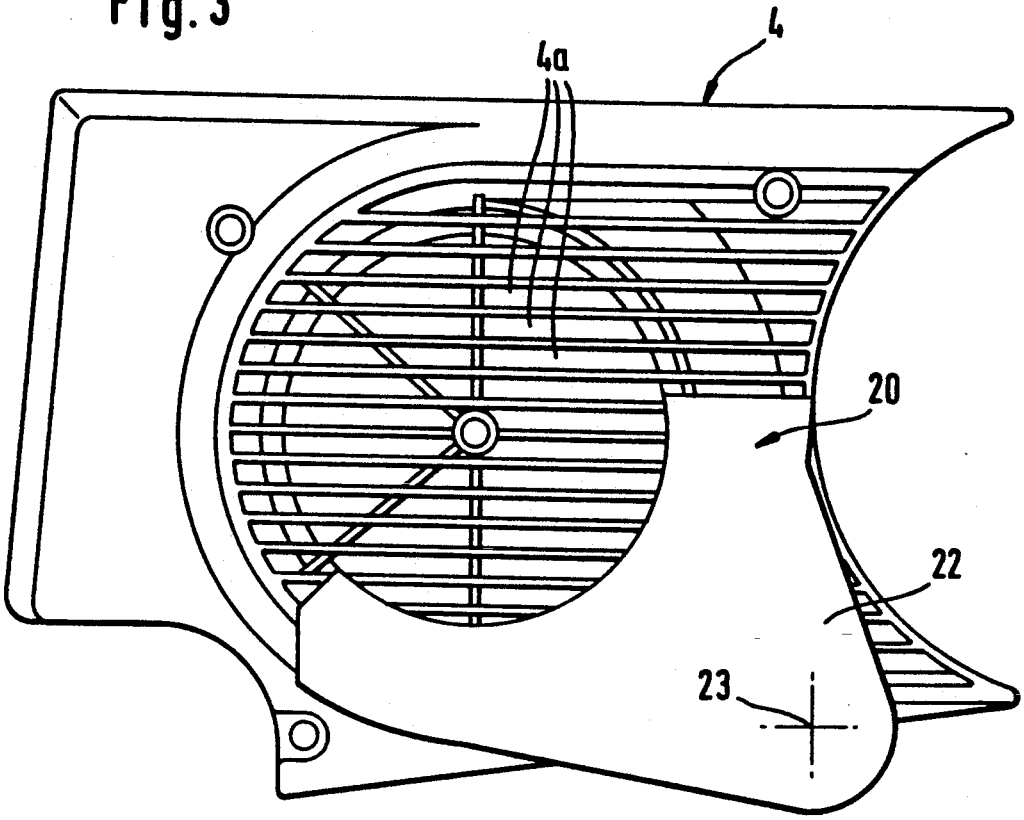
FIG. 3 is a plan view of the cover of the cooling blower of FIG. 2.

The housing part 50 shown in FIG. 1 is part of a portable handheld work apparatus such as a motor-driven chain saw, blower apparatus, cutoff machine or the like. A cooling-air channel or spiral 1 is formed in the housing and is configured as a cooling-air spiral in the embodiment shown. A fan wheel 2 of a cooling blower 3 is mounted at the center of the cooling-air spiral. As shown in FIG. 2, the fan wheel 2 is covered by a fan-wheel cover 4. The fan-wheel cover 4 covers the cooling-air spiral 1 at the same time so that this defines a U-shaped channel open toward the fan wheel 2. The cooling-air spiral is open over a part of the periphery which defines a cooling-air outlet 5 through which the cooling air flows to an internal combustion engine 10 and especially cools the cylinder 11 thereof. The cooling air is moved by the fan wheel 2 (rotating in the direction of arrow 6) in the longitudinal direction of the cooling-air spiral 1 and flows to the engine in a direction of the flow (arrows 9 and 7) shown in FIGS. 1 and 2. The engine is mounted in a portable handheld work apparatus and is an air-cooled two-stroke engine; however, the arrangement can be suitable for a four-stroke engine. The fan wheel 2 draws in air from the ambient (flow arrow 8 in FIG. 2) axially through the air inlet openings 4*a* in the fan-wheel cover 4 and moves this air tangentially into the cooling-air spiral 1 as indicated by flow arrows 9 by means of correspondingly formed vanes 2*a* which move in the rotational direction 6 of the fan wheel 2.

The fan wheel 2 is mounted on an end 12 of the crankshaft 13 of the internal combustion engine 10 and rotates in correspondence to the engine speed.

A combustion-air channel 20 is advantageously integrated into the fan wheel cover 4 as shown in FIG. 2. The combustion-air channel 20 lies in a plane parallel to the rotational plane of the fan wheel 2 and extends in the peripheral direction next to a part of the cooling-air spiral 1 as shown in FIG. 1. The combustion-air channel 20 is configured so that it is adapted to the cooling-air spiral in size and shape.

A configuration of the combustion-air channel 20 separate from the fan-wheel cover 4 can also be advantageous. In the embodiment shown, the combustion-air channel 20 extends over a peripheral angle of approximately 135°. The wall 21 of the combustion-air channel 20 facing toward the cooling-air spiral 1 also functions as a boundary wall for the cooling-air channel 1.

Starting from the wall 21, a profile hollow body 30 advantageously extends over essentially the entire axial width of the cooling-air channel 1 as shown in FIG. 2. The profile hollow body 30 is preferably configured as one piece with the combustion-air channel 20. In the embodiment shown, the free end 31 of the profile hollow body 30 is at a small spacing x to the axial inner wall 14 of the cooling-air channel 1 with the inner wall being defined by the housing part 50. As shown in phantom outline, a flush contact engagement of the profile hollow body 30 on the axial inner wall 14 can be advantageous.

As shown in FIGS. 1, 3, 4 and 6, the combustion-air channel 20 has a radial lateral appendage 22 through which the air entering into the combustion-air channel 20 via the profile hollow body 30 is guided to an air channel. This air channel is preferably configured as a tubular stub 23 arranged perpendicularly on the side of the appendage 22 facing toward the housing part 50. The tubular stub 23 conducts the air entering into the combustion-air channel 20 to the intake pipe 15 (FIG. 2) of the cylinder 11 in order to make the combustion air, which is necessary for operation, available to the engine 10.

Figure 4:
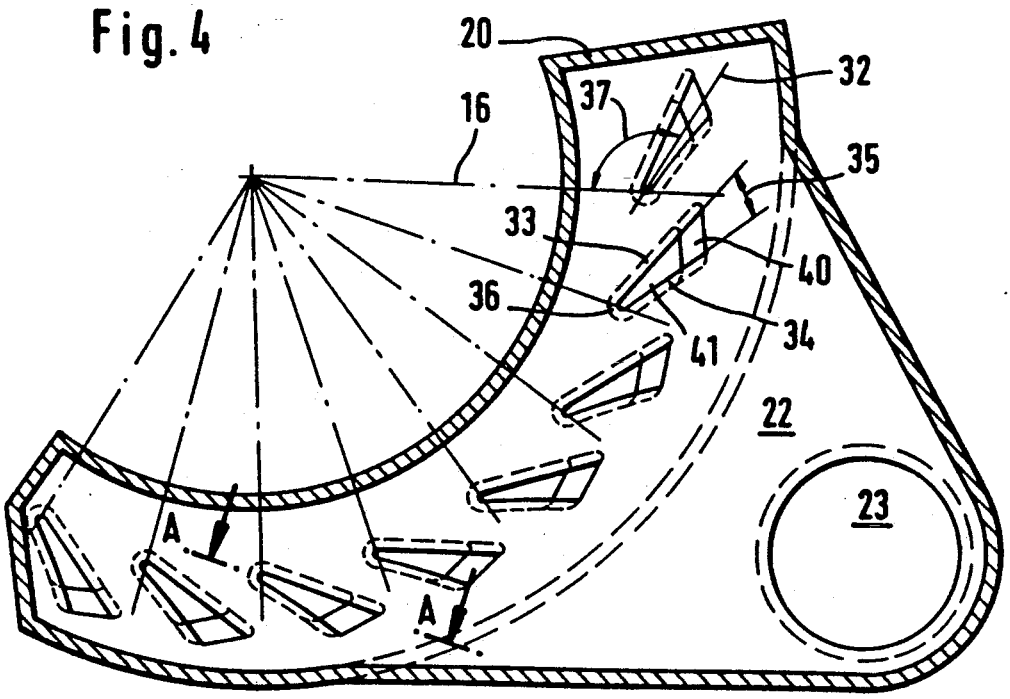
FIG. 4 is a section view through the combustion-air channel shown in FIG. 1.

In the embodiment shown, the profile hollow bodies 30 are configured approximately wedge-shaped in cross section, similar to a wing profile. The profile hollow bodies 30 lie in the cooling-air flow and are aligned to the flow direction at their respective positions (FIGS. 1, 4 and 6). This flow direction is compelled to be rotational because of the radial fan wheel. The profile hollow bodies 30 having a streamline configuration ensure that the cooling air entering into the cooling-air channel 1 and moved therein is only slightly obstructed in its flow and furthermore ensure that no additional eddy flows are formed on the side faces 33 and 34 (FIGS. 4 and 6) of the profile hollow bodies with the side faces 33 and 34 extending in the flow direction of the cooling-air flow; instead, the turbulent flow flows along on the side faces without separation. The side faces 33 and 34 of the profile body conjointly define an opening angle 35 of approximately 10° to 30°. In the embodiment shown, the opening angle 35 is 15°. The angle bisecting line 32 between the side faces 33 and 34 lies at an angle 37 of approximately 90° to 140° to a radial 16 of the cooling-air spiral 1 (FIG. 6). The radial 16 extends through the forward flow edge 36 of the profile hollow body 30. In this embodiment, the angle 37 is 120°. The forward flow edge 36 of the profile hollow body is disposed approximately perpendicularly to the plane of rotation of the fan wheel 2 and to the wall 21 of the combustion-air channel 20.

The side face 34 of the profile hollow body 30 facing away from the fan wheel is advantageously curved in the flow direction of the cooling air in correspondence to an aerodynamic wing geometry. This can be concave as in the embodiment shown. Other configurations of the curvature such as concave-convex, biconcave, biconvex and the like are likewise advantageous.

As shown in FIGS. 6 and 7, the side faces 33 and 34, which extend in flow direction of the cooling air, are configured to be longer close to the wall 21 of the combustion-air channel 20 than in the region of the base 41 of the free ends 31 of the profile hollow bodies 30. As shown in FIG. 5, a rear edge 38 (facing in a direction away from the flow) of the side faces 33 and 34 therefore results which lies at an acute angle 39 to the vertical axis 29 of the profile hollow body 30.

The inner space of the profile hollow body 30 communicates via a connecting opening 40 with the combustion-air channel 20. The connecting opening 40 essentially corresponds to the hollow space cross section of the profile hollow body 30. In the embodiment shown, and viewed in the direction of the vertical axis 29 of the profile hollow body 30, the connecting opening 40 is configured to be larger than or equal to the base 41 of the body 30 at the free end 31 thereof in the flow direction of the cooling air. The side faces 33 and 34 overlap the rear edge 42 of the connecting opening 40 and the rearward edge 43 of the base 41 as seen in the flow direction of the cooling air. The rearward edges 38 of the side faces 33 and 34 are therefore disposed rearward of the rear edges 42 and 43 of the connecting opening 40 and of the base 41 viewed in flow direction.

As seen in FIG. 6, the rear edges 42 and 43 are approximately parallel to each other at an angle 44 of approximately 55° to 75° (preferably at 65° as shown) to a radial 16 of the cooling-air spiral with the radial 16 extending through the forward flow edge 36 of the profile hollow body 30. Referred to the longitudinal center axis 32 of the profile hollow body 30, the rearward edges 42 and 43 are therefore at an angle 144 of 90° to 160° (preferably 125°) to the longitudinal center axis 32.

An inlet opening 25 is provided by the form and arrangement of the profile hollow body 30 on the rearward end thereof facing away from the flow. The inlet opening 25 is delimited by the rear edges 38 of the side faces 33 and 34, the rear edge 43 of the base 41 and the wall 21 of the combustion-air channel 20. The inlet opening 25 extends over the entire width and the entire elevation of the profile hollow body. It can be advantageous to form the inlet opening 25 smaller in dependence upon the combustion air throughput and/or the configuration of the engine.

The profile hollow body 30 is disposed so as to be aligned in correspondence to the flow direction of the cooling-air flow at the location of this body in the cooling-air channel 1. The profile hollow body 30 assures a flow therearound by the cooling-air flow which is substantially free of disturbance because of its streamline configuration. For this reason, the cooling-air flow is itself not significantly disturbed and, therefore, an adequate cooling of the engine is ensured for an unchanged dimensioning of the cooling blower 3. At the same time, this arrangement causes a flow separation to take place only at the rear edges 38 of the side faces whereby a pressure drop rearward of the rear edge 38 is produced. The cooling air entering into the inlet opening 25 has a low flow speed because of the configuration of the cross section so that dirt particles entrained in the cooling-air flow fly past the inlet opening 25 in the flow direction of the cooling air without a significant deflection because of their inertial energy. The cooling air passing into the combustion-air channel 20 via the inlet opening 25 is substantially free of dirt and is supplied as combustion air to the intake pipe 15 of the engine 10 and, if necessary, after first passing through a fine filter.

It is advantageous to provide a plurality of profile hollow bodies 30 disposed in the longitudinal direction of the cooling-air channel 1 so as to be disposed at equal spacings one behind the other in the flow direction of the cooling air. Each of the profile hollow bodies 30 is connected to the combustion-air channel 20. Unequal spaces or a functional spacing with continuously changing positions of the profile hollow bodies can be advantageous. This is dependent upon the shape of the spiral and the structural configuration thereof.

In the embodiment shown, the respective forward flow edges 36 of a plurality of profile hollow bodies 30 are disposed at equal spacings on a common circular arc segment 17 (FIG. 6). An arrangement on a spiral or a curve having any desired configuration can be advantageous. The radial 16 extends through the forward flow edge 36 as shown. The inclination of the profile hollow bodies referred to the radial 16 of the cooling-air spiral also can be equal as shown so that the rear edges 38 of the concavely curved side faces 34 of the profile hollow bodies 30 facing away from the fan wheel 2 likewise lie on a common circular arc segment 18.

In the embodiment shown, the profile hollow bodies 30 are disposed in a segment of the cooling-air spiral 1 which lies approximately diametrically opposite the cooling-air outlet 5. An early start of the arrangement of the profile hollow bodies in the spiral one behind the other is significant. The utilization of the entire peripheral length of the cooling-air spiral up to the cooling-air flow region near the cylinder is possible in order to draw off combustion air via a plurality of inlet openings 25.

In addition to the illustrated wedge form similar to a wing profile shown, the profile hollow bodies 30 can also be configured to have a parabolic shape, drop shape, prismatic shape or the like. The size of the profile hollow bodies is dependent upon the number of such bodies and the quantity of air flowing through the combustion-air channel 20. It is understood that the foregoing description is that of the preferred embodiments of the invention and that various changes and modifications may be made thereto without departing from the spirit and scope of the invention as defined in the appended claims.

What is claimed is:

1. A cooling-air blower for an internal combustion engine including a two-stroke engine of a portable handheld work apparatus, the engine having an intake pipe for receiving combustion air required for the operation of the engine, the cooling-air blower comprising:

a housing;

a fan wheel disposed in said housing and operatively connected to the engine for generating a cooling-air flow;

said housing having a cooling-air channel for conducting said cooling-air flow to the engine;

said housing also having a combustion-air channel for conducting the combustion air to the intake pipe of the engine;

said combustion-air channel having a segment thereof adjacent said cooling-air channel;

said housing including a profile hollow body extending from said combustion-air channel into said cooling-air channel;

said profile hollow body having an interior communicating with said combustion-air channel and being aligned in said cooling-air channel in the flow direction of said cooling-air flow;

said profile hollow body having a rear end facing away from said flow direction; and, said rear end defining an inlet opening therein for tapping and passing cooling air from said cooling-air channel through said interior and into said combustion-air channel.

2. The cooling-air blower of claim 1, said profile hollow body being configured so as to extend essentially completely through said cooling-air channel.

3. The cooling-air blower of claim 1, said cooling-air channel having inner and outer walls defining the width of said cooling-air channel; and, said profile hollow body extending across said width and having a lateral end disposed at a small spacing (x) from said inner wall.

4. The cooling-air blower of claim 1, said cooling-air channel having inner and outer walls defining the width of said cooling-air channel; and, said profile hollow body extending across said width and having a lateral end flush with said inner wall.

5. The cooling-air blower of claim 1, said profile hollow body having a streamlined profile shape when viewed in cross section.

6. The cooling-air blower of claim 5, said streamlined profile shape corresponding approximately to a profile shape which varies from a wing to a wedge.

7. The cooling-air blower of claim 5, said profile hollow body having first and second side faces, said side faces conjointly defining an open angle having an apex pointing into said cooling-air flow; and, said angle having a value in the range of approximately 10° to 30°.

8. The cooling-air blower of claim 7, said open angle being 15°.

9. The cooling-air blower of claim 7, said profile hollow body having first and second side walls defining said first and second faces, respectively; said profile hollow body having a vertical axis; one of said side walls having a rear edge facing away from said flow of the cooling air; and, said edge and said vertical axis conjointly defining an acute angle.

10. The cooling-air blower of claim 1, said cooling-air channel having inner and outer walls defining the width of said cooling-air channel; said profile hollow body extending along said width and having an inner end at said outer wall and an outer end at or near said inner wall; said profile hollow body having first and second side walls defining first and second faces, respectively; said faces having first and second widths measured in the direction of said cooling-air flow at said inner end and said outer end, respectively; and, said first width being equal to or longer than said second width.

11. The cooling-air blower of claim 7, said profile hollow body having first and second side walls defining said first and second faces, respectively; one of said side walls facing away from said fan wheel; and, said one side wall being configured to have a surface shaped to have an aerodynamic wing geometry.

12. The cooling-air blower of claim 1, said profile hollow body having an elevation measured at the rear end thereof and a length measured transversely to said direction of said cooling-air flow; and, said inlet opening of said profile hollow body extending over said entire elevation and length.

13. The cooling-air blower of claim 1, said housing including a plurality of said profile hollow bodies extending from said combustion-air channel into said cooling-air channel; and, said profile hollow bodies being disposed one behind the other in said flow direction of said cooling-air flow.

14. The cooling-air blower of claim 13, said profile hollow bodies being spaced at equal distances from each other.

15. A cooling-air blower for an internal combustion engine including a two-stroke engine of a portable handheld work apparatus, the engine having an intake pipe for receiving combustion air required for the operation of the engine, the cooling-air blower comprising:

a housing a radial fan wheel disposed in said housing and operatively connected to the engine for generating a cooling-air flow;

said housing having a cooling-air channel for conducting said cooling-air flow to the engine;

said cooling-air channel being formed in said housing so as to surround said fan wheel;

said cooling-air channel having an outlet formed therein for conducting said cooling-air flow to the engine;

said housing also having a combustion-air channel for conducting the combustion air to the intake pipe of the engine;

said combustion-air channel having a segment thereof adjacent said cooling-air channel;

said housing including a profile hollow body extending from said combustion-air channel into said cooling-air channel;

said profile hollow body having an interior communicating with said combustion-air channel and being aligned in said cooling-air channel in the flow direction of said cooling-air flow;

said profile hollow body having a rear end facing away from said flow direction;

said rear end defining an inlet opening therein for tapping and passing cooling air from said cooling-air channel through said interior and into said combustion-air channel;

said profile hollow body having a flow edge facing into said cooling-air flow and having a cross section defining a center axis;

said cooling-air channel having a spiral configuration and defining a radius passing through said flow edge; and, said profile hollow body being so positioned in said cooling-air channel that said center axis and said radius conjointly define an angle having a value in the range of approximately 90° to 140°.

16. The cooling-air blower of claim 15, said angle having a value of 120°.

17. The cooling-air blower of claim 15, said fan wheel defining a rotational plane and said flow edge being approximately perpendicular to said rotational plane.

18. The cooling-air blower of claim 15, said angle being a first angle; said housing defining a partition wall between said cooling-air channel and said combustion-air channel; said profile hollow body being arranged in said cooling-air channel so as to extend from said partition wall; said partition wall having a pass-through opening formed therein which communicates with said interior for passing the cooling air tapped in said cooling-air channel from said interior of said profile hollow body into said combustion-air channel; said pass-through opening having a rearward edge viewed in said flow direction; and, said rearward edge and said center axis conjointly defining a second angle having a value in the range of approximately 90° to 160°.

19. The cooling-air blower of claim 18, said second angle having a value of 125°.

20. The cooling-air blower of claim 18, said profile hollow body having an outer base wall defining an edge of said inlet opening and said edge and said center axis conjointly defining a third angle having a value of approximately 125°.

21. The cooling-air blower of claim 20, said pass-through opening being longer than said outer base wall viewed in said flow direction of said cooling air.

* * * * *